US007845821B2

(12) United States Patent
Herst et al.

(10) Patent No.: US 7,845,821 B2
(45) Date of Patent: Dec. 7, 2010

(54) FLOURESCENT LIGHTING FIXTURE MODULE FOR INDIRECT LIGHTING OF INTERIOR SPACES, AND METHOD

(75) Inventors: Douglas J. Herst, Ross, CA (US); Peter Y. Y. Ngai, Alamo, CA (US); Michael Trung Tran, Oakland, CA (US); Utkan Salman, Oakland, CA (US)

(73) Assignee: Acuity Brands, Inc., Atlanta, GA (US)

( * ) Notice: Subject to any disclaimer, the term of this patent is extended or adjusted under 35 U.S.C. 154(b) by 0 days.

(21) Appl. No.: 11/150,843

(22) Filed: Jun. 10, 2005

(65) Prior Publication Data

US 2006/0002100 A1 Jan. 5, 2006

Related U.S. Application Data

(60) Provisional application No. 60/579,040, filed on Jun. 10, 2004.

(51) Int. Cl.
*F21S 4/00* (2006.01)
*F21V 1/16* (2006.01)
*F21V 1/22* (2006.01)

(52) U.S. Cl. ..... 362/223; 362/217.02; 362/224; 362/225; 362/260

(58) Field of Classification Search ..... 362/225, 362/238, 252, 260
See application file for complete search history.

(56) References Cited

U.S. PATENT DOCUMENTS 2,288,606 A * 7/1942 Callahan ..... 362/224
2,334,005 A * 11/1943 Hoeveler ..... 362/223
2,341,895 A * 2/1944 Beck ..... 362/221
2,381,792 A * 8/1945 Wakefield ..... 362/224
2,545,058 A * 3/1951 Walsh ..... 362/224
2,761,058 A * 8/1956 Lipscomb ..... 362/218
3,123,310 A 3/1964 Dameral
3,158,327 A 11/1964 Dameral
3,169,710 A * 2/1965 Lipscomb ..... 362/260
3,214,580 A * 10/1965 Dameral ..... 362/219
3,755,667 A * 8/1973 Price ..... 362/217
D411,027 S 6/1999 Herst et al.
6,530,674 B2 * 3/2003 Grierson et al. ..... 362/225
6,769,785 B1 * 8/2004 Herst et al. ..... 362/221
6,837,593 B1 * 1/2005 Schutz et al. ..... 362/218

(Continued)

OTHER PUBLICATIONS

Peerless Lighting, "Envision Indirect Rounded 8×3", catalog, 1994.

(Continued)

*Primary Examiner*—Ismael Negron
(74) *Attorney, Agent, or Firm*—Beeson Skinner Beverly, LLP

(57) ABSTRACT

Fluorescent lighting fixture modules for indirect lighting of interior spaces, each module including at least one, and preferably a pair of side-by-side parallel linear indirect fluorescent lighting fixture elements suspended at fixed grid pattern locations beneath the ceiling of the open interior space. Each of the linear indirect lighting fixture elements is preferably no greater than approximately six feet in length with a suitable length being somewhat greater than four feet where a four foot lamp is used. Where the fixture elements are provided in pairs, each is suspended below the ceiling at its fixed grid location by a suitable hanger structure with a preferred overall fixture module width of approximately four feet.

11 Claims, 9 Drawing Sheets

U.S. PATENT DOCUMENTS

2003/0002279 A1* 1/2003 Fiene ..... 362/221

OTHER PUBLICATIONS

Peerless Lighting, 2 ¾×2½ Rectangular Lightline Indirect, catalog, 1996.
Peerless Lighting, "Lightfoil 9 Linear Pendant Mount, 2-Lamp T8", catalog, 1997.
Peerless Lighting, "Lightfoil 9 4' Chandelier, 2-Lamp T8", catalog, 1997.
Peerless Lighting, "Lightfoil 9 Linear Pendant Mount, Pendant Mount", catalog, 1997.
Peerless Lighting, "Envision Rounded 8×3 Indirect/Open, Pendant Mount", catalog, 1997.
Peerless Lighting, "Envision Rounded 8×3 Indirect/Open, X, T & L Connectors", catalog 1997.
Product Brochure, Peerless Lighting, "6" Round Systems," 1993.
Catalog Page, Peerless Lighting, "6" Round: Softshine Optics Wide Spread Down/Open Up," 1993.
Catalog Page, Peerless Lighting, "6" Round: Softshine Optics Wide Spread Up/Baffle Down," 1993.
Catalog Page, Peerless Lighting, "6" Round Dimensions Pendant Mount," 1993.
Catalog Page, Peerless Lighting, "9" Round: Softshine Optics Wide Spread Up & Down," 1993.
Catalog Page, Peerless Lighting, "9" Round: Softshine Optics Wide Spread Mostly Up," 1993.
Catalog Page, Peerless Lighting, "9" Round: Softshine Optics Wide Spread Mostly Down," 1993.
Catalog Page, Peerless Lighting, "10×3⅝" Rounded: Mostly Up (Open Up/Lens Down)," 1993.

* cited by examiner

FLOURESCENT LIGHTING FIXTURE MODULE FOR INDIRECT LIGHTING OF INTERIOR SPACES, AND METHOD

CROSS-REFERENCE TO RELATED APPLICATIONS

Applicants claim the benefit of U.S. provisional application No. 60/579,040 filed Jun. 10, 2004.

BACKGROUND OF THE INVENTION

The present invention generally relates to the lighting of interior spaces and, more particularly, to systems and methods for achieving indirect lighting in an interior space from ceiling suspended lighting fixtures.

Illuminating interior spaces, such as open offices, using indirect lighting systems is well known. One commonly used approach to indirect lighting in open office environments is to use linear indirect fluorescent lighting wherein elongated indirect fixture elements are suspended below the ceiling and arranged in rows or grid patterns to achieve a desired lighting environment. Normally, individual fixture elements are connected together to form continuous runs of fixtures including runs that have bends or intersect one another. In a typical installation, parallel runs of fixtures are provided with predetermined center-to-center spacings that achieve a desired illumination at task surfaces in the space and desired contrast-brightness ratios on the overhead ceiling. Typical center-to-center spacings for continuous runs of linear indirect fluorescent lighting are between eight and fifteen feet depending upon the fluorescent lamps used, the suspension height, and the distribution characteristics of the luminaire.

Current approaches to designing linear indirect fluorescent lighting systems suffer from the need to configure and install systems that are relatively complex to put together and install, or are visually bulky, or light up the interior space in ways that make it difficult to reconfigure the use of the space, such as by inserting or moving partition walls. The need exists for an indirect fluorescent lighting system that is visually pleasing, that provides a desired and and acceptable light distribution within the space, and that provides the greatest flexibility in reconfiguring an open office space without a detrimental impact on the quality of lighting in the environment. A need also exists for an indirect lighting system that can be used to replace recessed direct lighting fixtures commonly found in open office environments.

SUMMARY OF THE INVENTION

The present invention provides a method and system for uniformly illuminating an open interior space, such as an open office, by providing individual lighting fixture modules, each comprised of at least one, and preferably a pair of side-by-side parallel linear indirect fluorescent lighting fixture elements suspended at fixed grid pattern locations beneath the ceiling of the open interior space. Each of the linear indirect lighting fixture elements of the fixture module is preferably no greater than approximately six feet in length with a suitable length being somewhat greater than four feet when a four foot lamp is used. Where the fixture elements are provided in pairs, each is suspended below the ceiling at its fixed grid pattern location by a suitable hanger system that maintains a spacing between the fixture elements. The indirect fixture modules are especially well adapted to be suspended below a grid ceiling having square or rectangular ceiling grids for supporting square or rectangular ceiling tiles, however, they can be suspended below other ceiling structures as well. The length and spacing of the parallel fixture elements are such that will produce a fixture module footprint that is compatible with the perimeter of a 2' by 4' ceiling tile, or two adjacent 2' by 2' ceiling tiles, of a standard grid ceiling system. In accordance with the invention, the indirect lighting fixture modules are suspended below the grid ceiling at grid pattern locations that establish a spaced array of modules that produces a relatively uniform overhead lighting distribution throughout the space, and that provides a visually pleasing lighting environment. The spaced array of modules is formed by down rows of fixture modules in end-to-end alignment and cross rows of fixture modules in a side-to-side orientation. The fixture modules in the down rows are preferably provided on approximately eight foot center-to-center spacings, whereas the cross rows of fixture modules are preferably provided on either ten foot center-to-center spacings or eight foot center-to-center spacings. Each fixture module will preferably have a light spread that is sufficient to achieve a ceiling brightness uniformity of 8:1 or better, when suspended at least eight feet by eight feet apart on center.

The lighting fixture modules of the system of the invention are most suitably used with lamps having the relatively small dimensions of a T-5 lamp, along with suitable reflector optics for spreading the light to the overhead ceiling. The maximum cross-sectional dimension of the lighting fixture elements of the modules are relatively small compared to the length of the fixture elements, and in the illustrated embodiment is approximately three inches, which is compatible with the small diameter of a T-5 lamp.

In a further aspect of the invention, the housing for each of the indirect fluorescent fixture elements of each lighting fixture module is made of a diffuser material—suitably opal acrylic—that receives some light from the fluorescent lamps. The result is that the fixture housings appear at least partially luminous, thereby introducing a pleasing aesthetic appearance into the visual environment. Preferably the ends of the fixture elements that extend beyond the lamp ends are painted or otherwise treated to render them opaque and therefore non-luminous. The luminous housings introduce a small percentage of direct lighting into the space, and, in combination with the geometry, spacing and size of the lighting fixture modules of the system, create a visually pleasing lighting environment that is substantially uniformly illuminated.

By providing the lighting fixture modules in an eight foot by ten foot on-center grid array, the fixture modules can be installed on the T-bars of a conventional overhead grid ceiling system having a 2'×2' or 2'×4' grid pattern. Also, the eight foot by ten foot on center array corresponds to the conventional center-to-center spacings of recessed down lights in a typical down lit office space using two by four foot recessed troffers. Thus, an interior space having a down light system comprised of a standard array of recessed down lights can be easily retrofitted with indirect lighting fixture modules of the invention by first hanging the modules from the grid ceiling beneath the space where the recessed down lights have been removed, and then replacing the ceiling tile or tiles above the suspended fixtures. As compared to conventional indirect lighting systems consisting of continuous rows of similar linear fixture elements (same lamps and same number of lamps), the discreet side-by-side pair of indirect lighting fixture elements of each of the lighting fixture modules of the invention will produce a better ceiling brightness distribution. The eight foot by ten foot centers of the array of fixtures have the additional advantage, as compared to continuous rows of fixtures, that the interior space can more easily be divided up by partition walls without significantly affecting the quality of the lighting environment in the divided up space.

It is contemplated that the fixture modules used to create a modular indirect lighting system can be used under dry wall or other types of ceilings in addition to grid ceilings. It is further contemplated that the indirect fixture modules can be comprised of a single linear indirect lighting fixture element or even three or more parallel linear indirect fixture elements.

Therefore, it can be seen that it is a primarily object of the invention to provide an improved system and method of indirectly lighting an interior space using relatively short linear fluorescent lighting elements configured into indirect lighting modules that can be suspended from a ceiling at appropriate center-to-center spacings, preferably at least eight foot by eight foot spacings and most suitably 8 foot by 10 foot spacings.

It is another object of the invention to provide a modular indirect lighting system that can used to replace conventional open office down lighting systems, such as two by four foot recessed troffers.

It is a further object of the invention to provide an indirect lighting system having ceiling suspended indirect lighting modules that are aesthetically pleasing when viewed in an interior space.

Still other objects of the invention will be apparent from the following specification and claims.

DESCRIPTION OF THE ILLUSTRATION EMBODIMENT

As used herein, reference to an "indirect" lighting fixture, module or element is not limited to totally indirect lighting, and shall be understood to include lighting fixtures, modules, or elements that provide up light as well as a component of down light.

Figure 1:
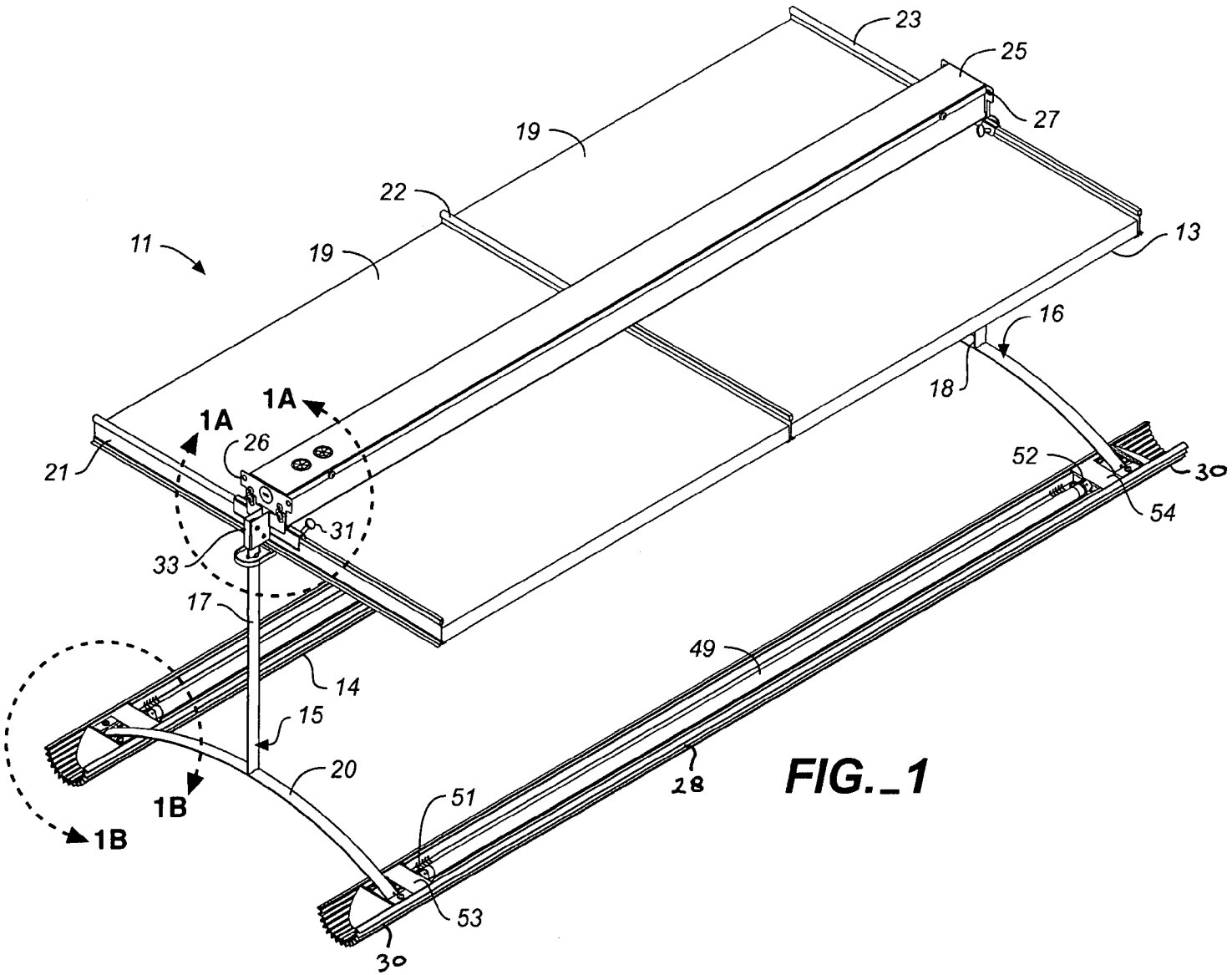
FIG. 1 is a top perspective view of an indirect lighting fixture module in accordance with the invention suspended below a grid ceiling system.
Figure 1A:
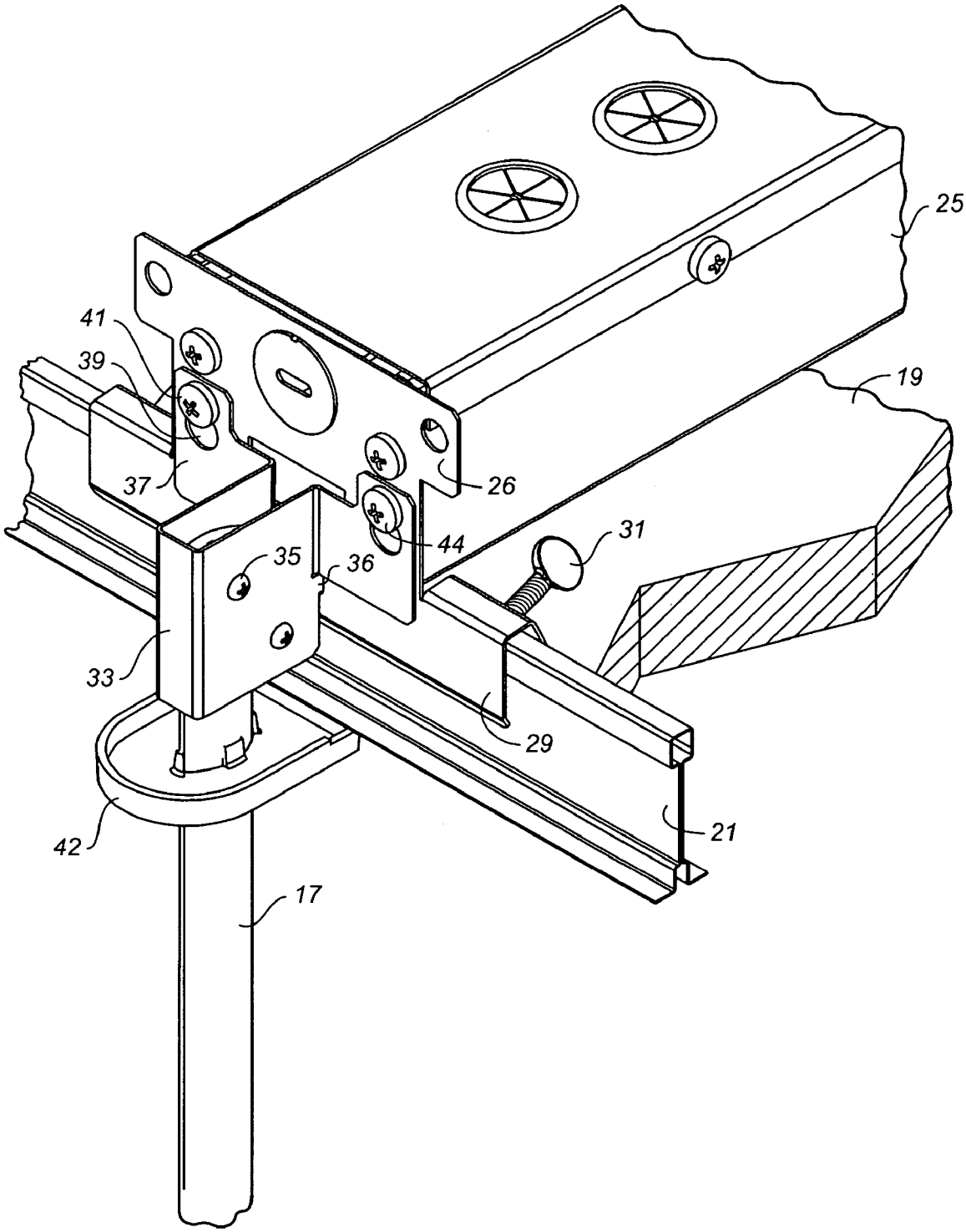
FIG. 1A is an exploded fragmentary view thereof taken along lines 1A-1A in FIG. 1.

Referring to FIGS. 1, 1A, 2 and 4, an indirect lighting fixture module 11 having parallel side-by-side linear indirect fluorescent lighting fixture elements 12, 14 is shown suspended below a grid ceiling system 13 by means of two hangers 15, 16 nominally spaced apart by about four feet to correspond with the spacing T-bars of a grid ceiling, but which could have other separations for particular applications. For illustrative purposes, only a small portion of the grid ceiling system is shown in FIG. 1, namely, two tiles 19 of the grid ceiling and three parallel sections of T-bar 21, 22 and 23. With two foot by two foot tiles, this section of the ceiling provides an approximately two foot by four foot profile, under which the indirect lighting fixture module 11 is suspended. While the installation is illustrated in respect to a 2'×2' grid ceiling, it is understood that the fixture module described herein could similarly be installed below a 2'×4' tile of a 2'×4' grid ceiling.

The side-by-side linear indirect fluorescent lighting fixture elements 12, 14 are seen to have a center portion for the fixture element's lamp 49 and outboard free ends for internal hardware as hereinafter described. Each lighting fixture element is relatively short as compared to the long runs of linear lighting fixtures typically found in linear indirect lighting installations. Preferably, the length of these fixture elements are compatible with the four foot dimension of a 2'×4' ceiling grid, and preferably not substantially exceeding five feet for a four foot lamp and six feet for a five foot lamp. At these lengths, the free ends of the fixture elements will extend somewhat beyond each side of the four foot length of a 2'×4' ceiling grid when oriented in the long direction of the grid, yet will be compatible with the grid dimensions. These lengths will also allow hangers to be attached to the free ends of the fixture elements at four foot spacings as hereinafter described so that the free ends of the fixture elements extend somewhat beyond the hangers.

Figure 1B:
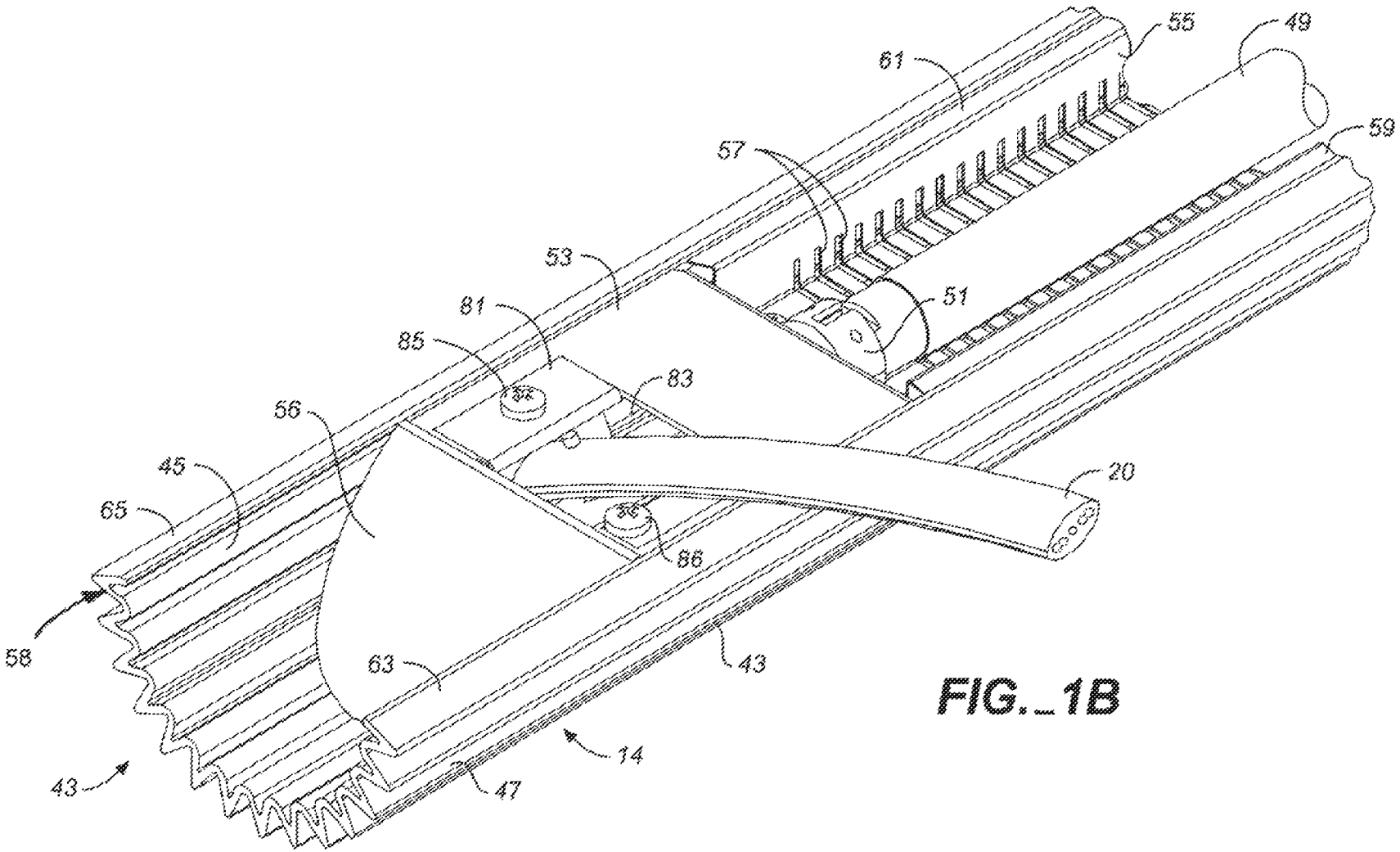
FIG. 1B is an exploded fragmentary view thereof taken along lines 1B-1B in FIG. 1.

The indirect lighting fixture module 11 is suitably a remote ballast module, wherein the ballast for electrifying the fluorescent lamps of the module is located above the grid ceiling. The ballast (not shown) is housed within an elongated ballast box 25 having end plates, 26, 27. It can be seen that the length of the ballast box, which is nominally about four feet, corresponds with separation between parallel T-bars 21, 23 of the grid ceiling. The ballast box attaches to T-bars 21, 23 by channel edge structures 29 formed on the bottom of each of the box's end plates 26, 27. As best seen in FIG. 1B, the channel structures of the end plates fit over the top of the T-bar 21 to allow the location of the ballast box, and hence the hanging points of the fixture module 11, to be adjusted along the supporting T-bars. Once positioned, the ballast box can be secured by thumb screws 31 which clamp the ballast box end plates to the grid ceiling T-bars.

With the ballast box in position, indirect lighting fixture module 11 can easily be attached to the end plates of the ballast box. In the illustrated embodiment, this is accomplished by means of a hanger bracket 33 attached by screws 35 to the top end of the vertical support stems 17, 18 of the fixture hangers 15, 16. Each of the hanger brackets 33 are provided with a mounting plate 37 having key holes 39 sized to fit over and down onto hanger support screws 41 on the ballast box end plates 26, 27. At the same time, lower projecting hooks 36 on the interior edges of the bracket fit into corresponding slots (not shown) in the ballast box end plate to stabilize the hanger and suspended fixture module against lateral forces that might cause the fixture module to swing, such as forces produced by an earthquake. Once engaged, hanger bracket 33 is secured to the ballast box end plate by tightening the hanger support screws 41.

It is contemplated that the hangers 15, 16 of indirect lighting fixture module 11 will be pre-wired and pre-assembled at the factory and fixture modules assembled at a job site as described below. An installation of the assembled fixture modules in accordance with the method of the invention is relatively straightforward and easy to accomplish, requiring first the installation of ballast boxes, such as the illustrated boxes 25, at the pre-determined grid pattern locations on the overhead grid ceiling, and then the hanging of the lighting fixture modules from the ends of the ballast boxes as described above. Such an installation would be undertaken with the ceiling tiles immediately adjacent to the ends of the ballast boxes removed to provide access to the area above the grid ceiling at the grid pattern hanging locations. When these ceiling tiles are replaced, they would be provided with suitable cut-outs for the hanger's vertical stems 17, 18 which would be covered by plastic canopies 42.

It is noted that, while the ballast boxes are nominally four feet long so they can span two tiles of a 2'×2' ceiling grid or one tile lengthwise of a 2'×4' ceiling grid, ballast boxes of other lengths could be provided to accommodate fixture modules with different hanger separations. For example, a ballast box somewhat longer than four feet could be provided and mounted to the ceiling grid, so that it overhangs a 2'×4' grid space and so that it accommodates a fixture module that is intended to similarly overhang the grid space. In this case, the hanger on the extended end would penetrate the ceiling tile at a point remote from the edge of the tile, requiring a longer ceiling tile canopy to cover the required slot in the tile.

Figure 1C:
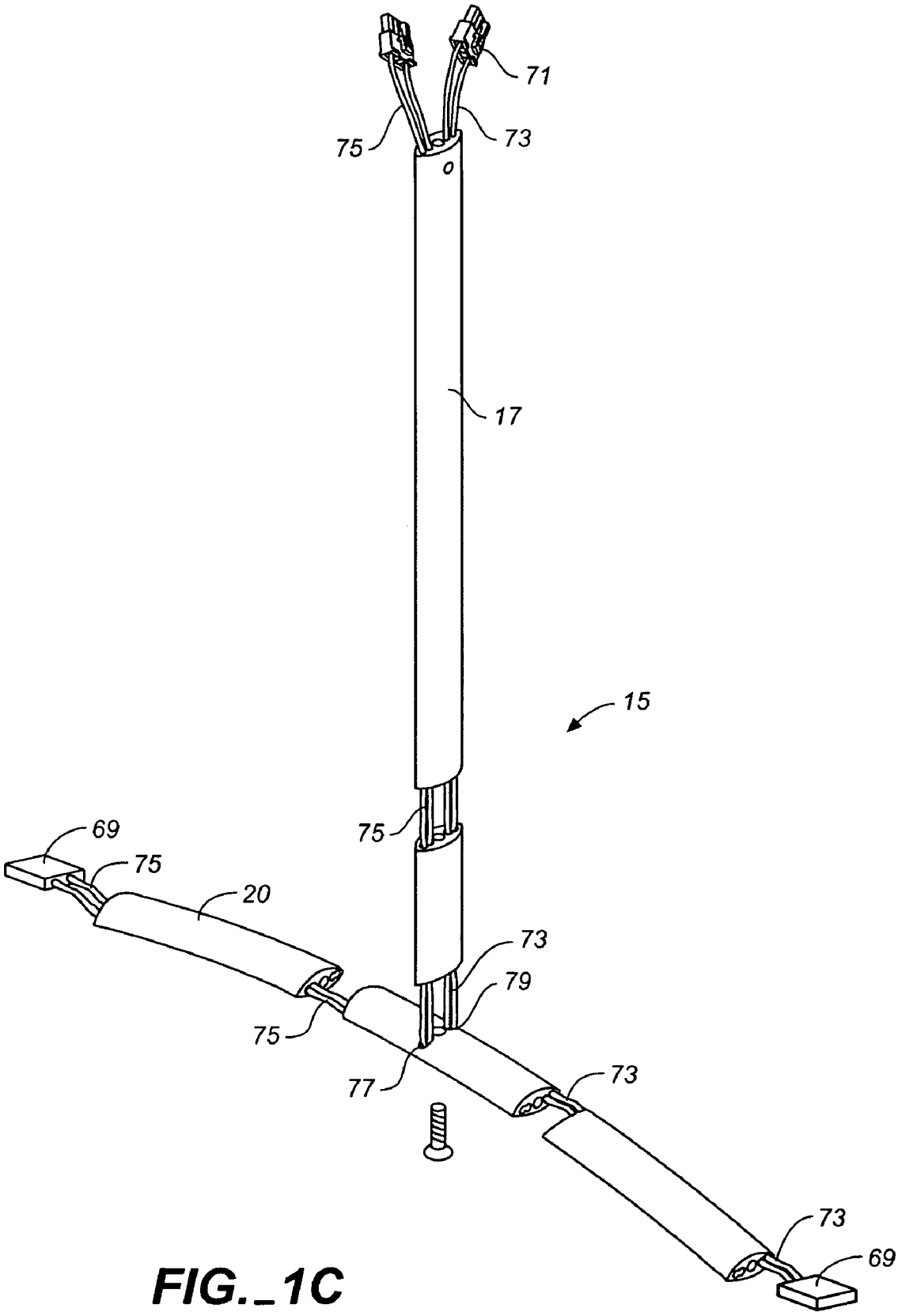
FIG. 1C is a top perspective view, partially cut-away, of one of the hangers for the indirect lighting fixture module shown in FIG. 1.

The connection of the linear indirect lighting fixture elements to hangers 15, 16 and the wiring of these fixtures to the remote ballast box 25 is illustrated in FIGS. 1B and 1C. In the illustrated embodiment, the indirect lighting fixture elements 12, 14 have a relatively small profile, suitably approximately three inches across the top of each fixture element, and are comprised of a housing 43 having inner and outer convoluted surfaces 45, 47, giving the housing a crenulated cross-sectional shape. In the illustrated and preferred embodiment of the invention, the housing 43 is fabricated of a white diffuse plastic such as opal acrylic, which provides a diffuser housing for diffusing light directed to the interior surface of the housing from the fixture's fluorescent lamp 49. The lamp is held by lamp sockets 51, 52 mounted to end brackets 53, 54, which have angled outer cover plates, such as cover plate 56 shown in FIG. 1B, for covering the optical elements and hanging hardware contained in the housing. Reflector 55 positioned beneath the fluorescent lamp 49 is provided with slots 57 of a suitable size and configuration to allow a pre-determined amount of light from the fluorescent lamp to reach the housing. It is seen that end brackets 53, 54 and reflector 55 each have top edge structures, such as top edges 59, 61 of the reflector, which fit underneath inwardly projecting lips 63, 65 at the top edge portions 58 of the housing 43, which define the top of the housing. This allows the reflector and end brackets to be contained within the housing, and to be easily installed by sliding these elements into one of the housing's open ends 67.

As a result of the light passing through the reflector, the center portion 28 of the diffuser housing between end brackets 53, 54 will be illuminated and produce a visible luminous surface along the central portion of the indirect lighting elements. Since the fixture element lamps 49 do not extend to the ends 46 of the diffuser housings and since the free ends 30 of the diffuser housings contain the lamp sockets, associate wiring, and connection hardware for indirect lighting fixture elements 12, 14, the free ends of the diffuser housings would receive little of the light emitted by the lamps. Thus, the ends of the housings are preferably painted or otherwise treated to make them opaque. Suitably, they can be painted with a grey primer and white overcoat. When illuminated, these fixture element ends will appear dark in relation to the rest of the housing. The luminous surfaces will add a small component of down lighting to the interior space below the fixture modules, while providing pleasing luminous surfaces associated with the fixture modules that can be seen at normal viewing angles.

It is noted that patterns of openings other than the shown reflector slots 57 can be provided in the reflector to achieve desired brightness characteristics across the luminous housing. Such patterns of openings might include a combination of round openings and slots or sculpted slots that vary the amount of light directed to the inner convoluted surface 45 of the housing, for example, to compensate for variations that might exist in the distance between the surfaces of lamp 49 and this inner surface.

It is further noted that the double convoluted surfaces 45, 47 of the diffuser housing of the indirect lighting fixture elements 12, 14 uniquely permit the surface brightness characteristics across the housing's outer surface 47 to be controlled by the designer.

The fixture elements' lamp sockets, such as lamp socket 51 shown in FIG. 1B, are wired to the remote ballast box through the hangers 15, 16, such as generally illustrated in FIG. 1C. To facilitate connection of the wires, the ends of the socket wires, ballast wires, and wires threaded through the hanger are provided with quick disconnect connectors such as the connectors 69, 71, shown in FIG. 1C. As further shown in FIG. 1C, the hanger receives two wire pairs 73, 75, one wire pair for each socket. The wire pairs are threaded through the hanger's curved cross piece 20, and pulled through wire exit holes 77, 79 in the center of this cross piece. From there they are threaded up through the vertical support stem of the hanger.

As best shown in FIG. 1B, the linear indirect lighting fixture elements are connected to the outboard ends of the hanger cross piece 20 by means of connector brackets, such as the illustrated connector bracket 81, that fit within openings 83 in the top of the fixture element's end brackets 53, 54. Once inserted into these openings, the connector brackets, which are suitably secured to the outboard ends of the hanger's cross piece 20 by screw attachments (not shown), are fastened by means of mounting screws, such as the illustrated mounting screws 85, 86.

Figure 2:
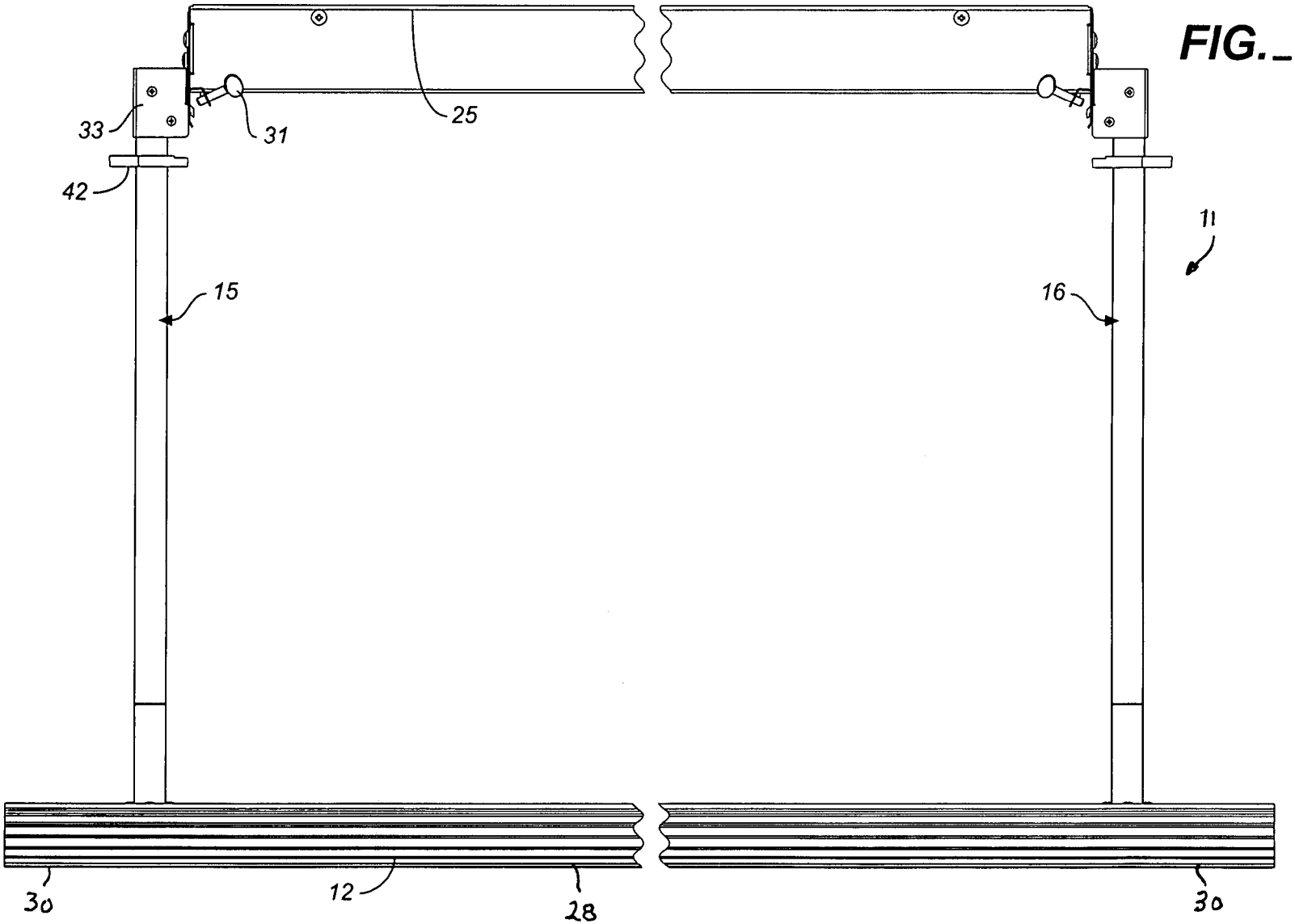
FIG. 2 is a side elevational view of the indirect lighting fixture module shown in FIG. 1.
Figure 3:
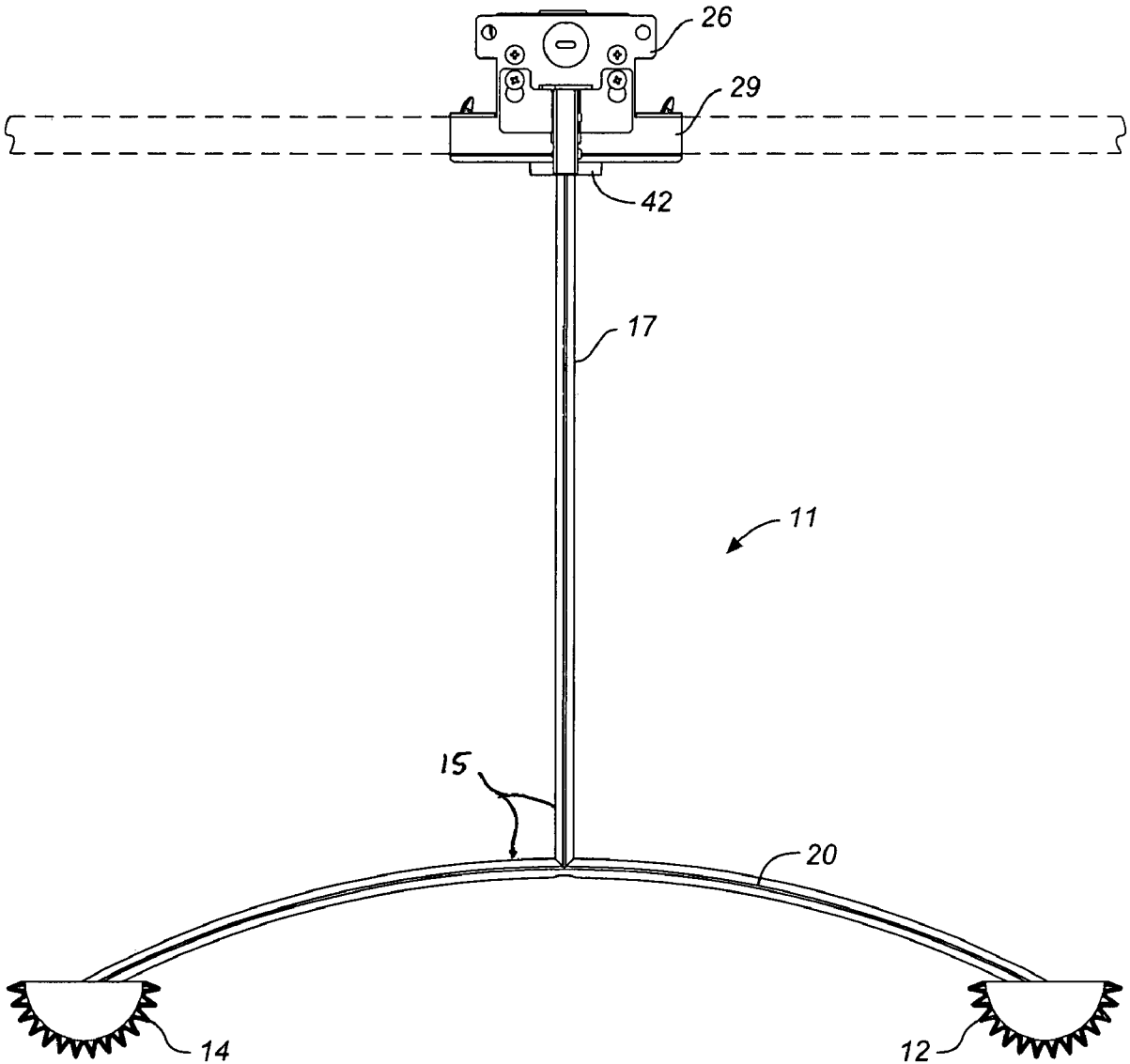
FIG. 3 is an end elevational view thereof.
Figure 4:
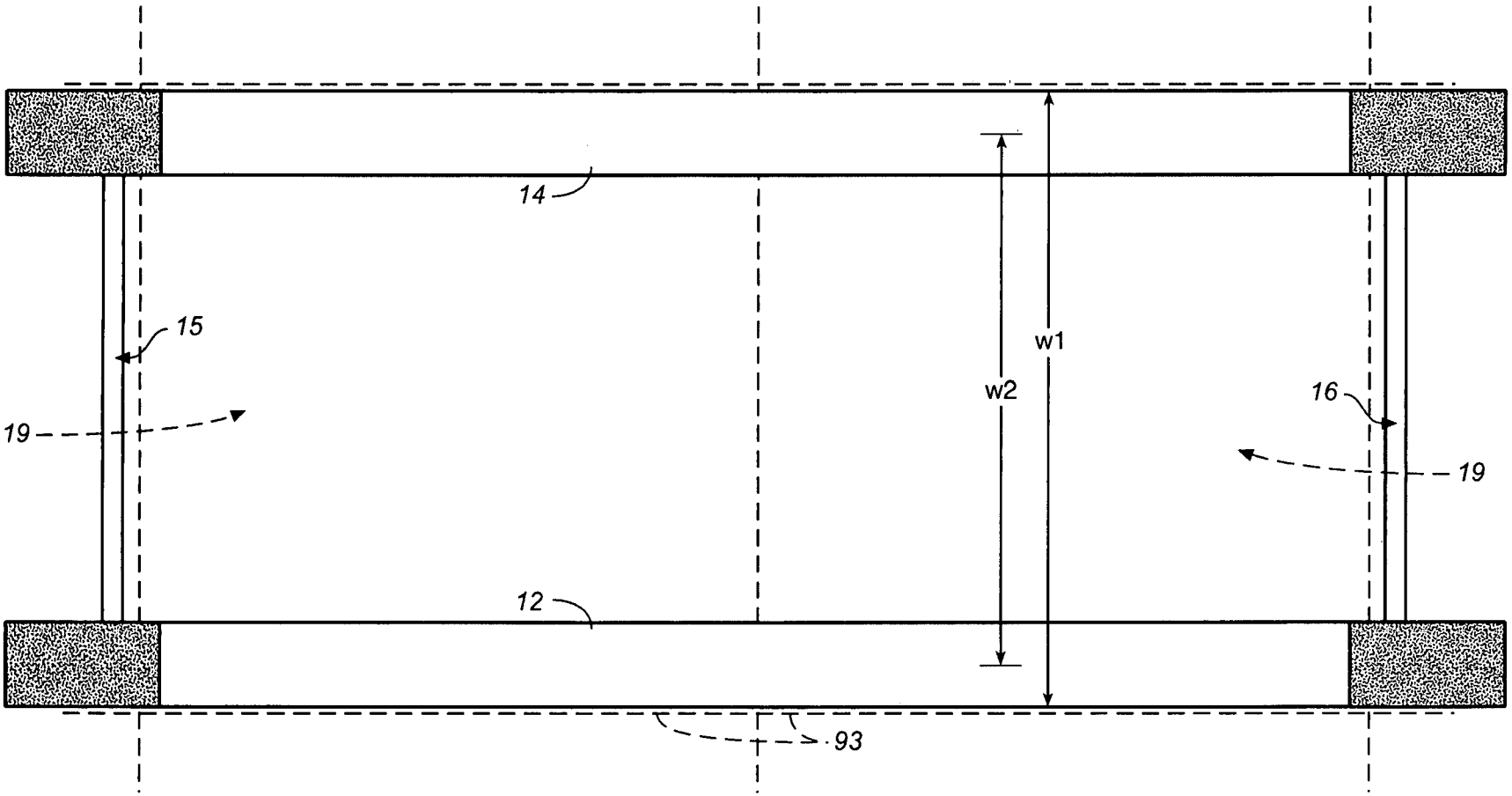
FIG. 4 is a bottom plan view thereof.

FIG. 4 shows a lighting fixture module such as illustrated in FIGS. 1-3 in a bottom plan view against two 2'×2' ceiling tiles forming a larger 2'×4' grid cell 93. Again, while a 2'×2' ceiling grid is shown, the invention can also be used in connection with a 2'×4' grid ceiling having 2'×4' tiles. With a nominal hanger spacing of approximately four feet, the modules' fixture elements 12, 14 lengthwise span and extend just beyond the two overhead ceiling grid tiles, that is, a 2'×4' grid cell. The width of the fixture module, denoted W1 in FIG. 4, would be just under two feet based on a center-to-center spacing (W2) of twenty inches for the indirect lighting fixture elements 12, 14, and an overall width for the individual fixture elements of approximately three inches. Thus, the overall width W1 of the module will approximate the width of 2'×4' grid cell, while the length of the module, as defined by the length of the lighting fixture elements, just overhangs the grid cell. (It is mostly the non-luminous ends of the fixture elements that overhang the cell.) Such a profile advantageously fits within a 2'×4' grid ceiling space familiar to contractors, and allows for retrofitting interior spaces having conventional recessed lighting schemes with an indirect lighting system that provides relatively uniform ceiling brightness within the interior space.

Figure 5:
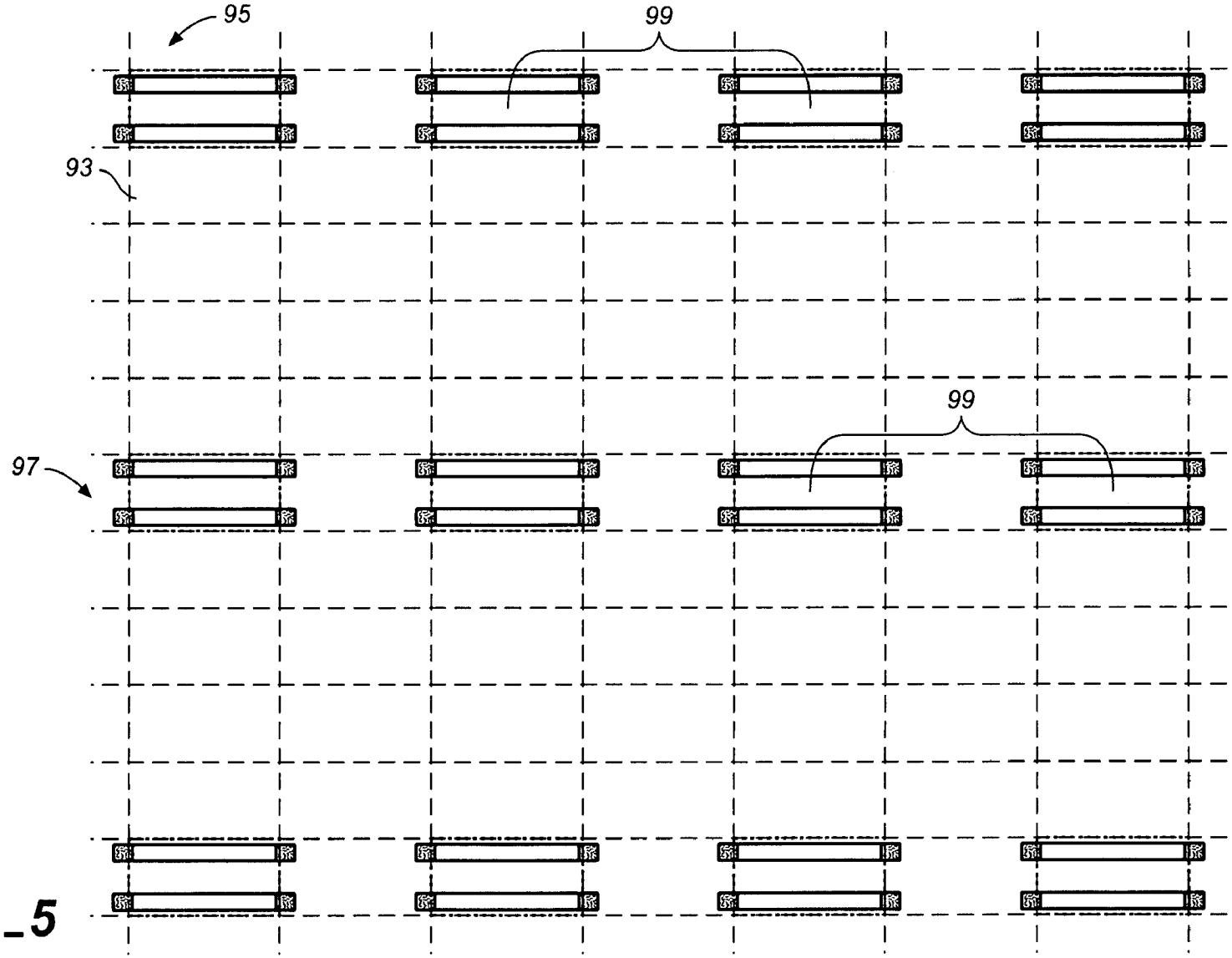
FIG. 5 is a graphical representation of an array of indirect lighting fixture modules as illustrated in FIGS. 1-4 provided at fixed grid pattern locations on eight by ten foot centers.

FIG. 5 is a graphical representation of an array of direct lighting fixture modules, dimensioned in accordance with the invention, beneath a grid 91 representing an overhead grid ceiling having 2'×4' tile areas or grid cells 93. The grid is further defined by down rows 95 and cross rows 97, and grid pattern locations 99 from which the fixture modules are suspended. It has been discovered that grid pattern locations for the lighting fixture modules as above described that are on eight foot by ten foot centers on the grid provide an aesthetically pleasing lighting environment in terms of the visual aspects of the suspended lighting fixture modules and in terms of the light distribution within the room and on the overhead ceiling produced by such modules. More specifically, the fixture modules 11 are spaced apart along the down rows 95 of the overhead grid 91 eight feet on center, while the spacing of the fixtures on the cross rows of the grid is ten feet on center. Such a pattern corresponds to the conventional pattern of 2'×4' recessed ceiling fixtures of a conventional downlight (direct lighting) installation.

Figure 6:
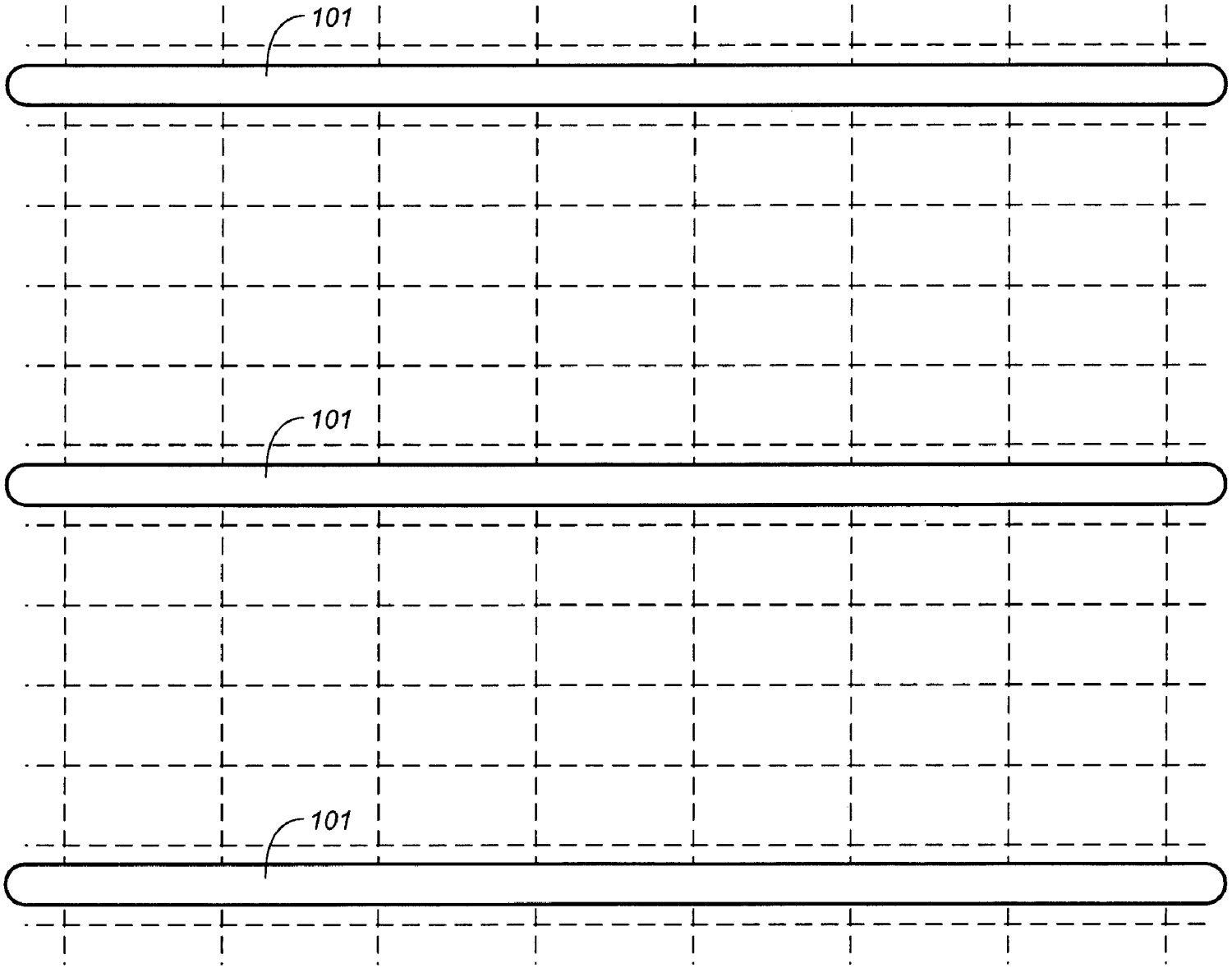
FIG. 6 (PRIOR ART)
FIG. 6 is graphical representation of a conventional prior art system of continuous rows of indirect lighting fixtures suspended below the grid shown in FIG. 5.

For comparison, an example of ceiling suspended indirect lighting fixtures in continuous rows as known in the prior art is illustrated in FIG. 6. In this example, the continuous rows of fixtures 101 are suspended ten feet on center in reference to the down rows of the grid. Such continuous rows extend through multiple cells of the grid and limit a designer's ability to partition the interior space into useable areas without interfering with the fixture runs.

While the invention has been described in considerable detail in the foregoing specification, it is not intended that the invention be limited to such detail, except as necessitated by the following claims.

What is claimed is:

1. An indirect lighting fixture module for an indirect lighting system for illuminating an interior space having an overhead ceiling, said lighting fixture module comprising at least two relatively short linear indirect fluorescent lighting fixture elements, each of said linear indirect fluorescent lighting fixture elements including at least one fluorescent lamp capable of being energized wherein, when energized, light from the at least one fluorescent lamp is directed upwardly from the lighting fixture elements toward an overhead ceiling, and each of said lighting fixture elements having a substantially uniformly shaped linear housing having top edge portions defining the top of the linear housing and free ends that conform to the shape of said housing, the linear housing of each of said lighting fixture elements being fabricated of a light transmissive material extending substantially entirely around the periphery of the housing between the top edge portions thereof and over at least a substantial portion of its length and having an outer surface visible from below the lighting fixture module which is luminous when the fluorescent lamp of the lighting fixture element is energized, the outer surface of the linear housing of each of said lighting fixture elements being visible against the overhead ceiling, and the portion of the length of said linear housing which is fabricated of said light transmissive material receiving a portion of the light produced by the fluorescent lamp held by said lighting fixture element such that at least a portion of the length said linear housing as seen from below the lighting fixture module is luminous when the fluorescent lamp of the lighting fixture element is energized, and a hanger structure for interconnecting and holding only said linear indirect fluorescent lighting fixture elements in substantially parallel, side-by-side relation, and for suspending said lighting fixture elements from an overhead ceiling free of other linear elements, said at least two substantially parallel linear indirect fluorescent lighting fixture elements producing an indirect lighting fixture module which projects a generally rectangular profile against an overhead ceiling from which the fixture module is suspended.

2. The lighting fixture module of claim 1 wherein the rectangular profile projected by the indirect lighting fixture module does not exceed approximately two feet in width and approximately six feet in length.

3. The lighting fixture module of claim 1 wherein the rectangular profile projected by the indirect lighting fixture module is approximately two feet by at least four feet.

4. The lighting fixture module of claim 1 wherein the maximum cross-section dimension across each of said linear indirect fluorescent lighting fixture elements is approximately three inches.

5. The lighting fixture module of claim 1 wherein the free ends of said linear indirect fluorescent lighting fixture elements are opaque and non-luminous.

6. The lighting fixture module of claim 1 wherein the linear housing of each of said linear indirect fluorescent lighting fixture elements is fabricated of a diffuser material, and wherein said lighting fixture elements are further comprised of opposed end brackets held in said housing at the free ends thereof, lamp sockets mounted to said end brackets for receiving and holding the at least one fluorescent lamp in the housing between said end brackets, and electrical means connected to said lamp sockets for energizing the at least one fluorescent lamp held thereby.

7. The lighting fixture module of claim 6 wherein said electrical means for energizing the at least one fluorescent lamp held by said lamp sockets includes electrical wiring threaded through said hanger structure for wiring said sockets to a remote ballast.

8. The lighting fixture module of claim 1 wherein said hanger structure includes two hangers for interconnecting the free ends of said substantially parallel lighting fixture elements and for suspending the free ends of said fixture elements from an overhead ceiling.

9. The lighting fixture module of claim 8 wherein each of said hangers includes a cross piece for interconnecting the free ends of said lighting fixture elements, and a vertical stem extending upwardly from said cross piece for suspending the cross piece and free ends of said substantially parallel fixture elements from an overhead ceiling.

10. The lighting fixture module of claim 9 wherein the vertical stems of said hangers are adapted to hang off of the T-bars of a grid ceiling system.

11. An indirect lighting fixture module for an indirect lighting system for illuminating an interior space having an overhead ceiling, said lighting fixture module comprising two relatively short linear indirect fluorescent lighting fixture elements having a substantially uniformly shaped linear housing with free ends that conform to the shape of said housing and including at least one fluorescent lamp capable of being energized, the linear housing of each of said lighting fixture elements having a circumference, an outer surface visible from below the lighting fixture module, and being fabricated substantially entirely of a light transmissive diffuser material over about the circumference thereof for at least a substantial portion of its length, wherein substantially the entirety of said linear housing is luminous over at least a substantial portion of the length of said housing when the fluorescent lamp held therein is energized, and a hanger structure for interconnecting and holding said linear indirect fluorescent lighting fixture elements in substantially parallel, side-by-side relation, and for suspending said substantially parallel lighting fixture elements from an overhead ceiling free of other suspended structures between the side-by-side indirect fluorescent lighting fixture elements, said substantially parallel linear indirect fluorescent lighting fixture elements producing an indirect lighting fixture module which projects a generally rectangular profile against an overhead ceiling from which the fixture module is suspended, said rectangular profile having a width and length which do not exceed approximately two feet by six feet.

* * * * *

UNITED STATES PATENT AND TRADEMARK OFFICE

CERTIFICATE OF CORRECTION

PATENT NO. : 7,845,821 B2
APPLICATION NO. : 11/150843
DATED : December 7, 2010
INVENTOR(S) : Douglas J. Herst et al.

It is certified that error appears in the above-identified patent and that said Letters Patent is hereby corrected as shown below:

Title Page item 54 and Col. 1 line 1
In the title, “FLOURESCENT LIGHTING” should read --FLUORESCENT LIGHTING--.
In column 3, line 9, “primarily” should read --primary--.
In column 3, line 47, “is graphical” should read --is a graphical--.
In column 6, line 62, --a-- should be inserted between “of” and “2'x4”'.
In column 8, line 2, --of-- should be inserted between “length” and “said”.

Signed and Sealed this
Third Day of May, 2011

David J. Kappos

David J. Kappos
*Director of the United States Patent and Trademark Office*